United States Patent [19]

Gane

[11] 3,964,414

[45] June 22, 1976

[54] EASY OPEN END METHOD AND APPARATUS

[75] Inventor: Gordon R. Gane, Pleasanton, Calif.

[73] Assignee: Kaiser Aluminum & Chemical Corporation, Oakland, Calif.

[22] Filed: Apr. 7, 1975

[21] Appl. No.: 565,494

Related U.S. Application Data

[60] Division of Ser. No. 478,407, June 11, 1974, Pat. No. 3,902,627, which is a continuation-in-part of Ser. No. 448,157, March 4, 1974, abandoned.

[52] U.S. Cl. ..... 113/121 C; 113/1 F

[51] Int. Cl.[2] ..... B21D 51/44

[58] Field of Search ..... 113/1 R, 1 F, 15 A, 113/121 C; 220/266, 268, 269

[56] References Cited

UNITED STATES PATENTS

| | | | |
|---|---|---|---|
| 3,362,569 | 1/1968 | Geiger | 220/268 |
| 3,550,546 | 12/1970 | Eickenhorst | 113/121 |
| 3,794,206 | 2/1974 | Deline et al. | 220/268 |
| 3,902,626 | 9/1975 | Jordan et al. | 220/266 |
| 3,912,114 | 10/1975 | Morran et al. | 220/268 |

*Primary Examiner*—Lowell A. Larson
*Attorney, Agent, or Firm*—Paul E. Calrow; John S. Rhoades

[57] ABSTRACT

This invention relates to an easy open ecological closure member as well as processes and equipment for producing the same. The closure member is provided with readily depressible and hinged opening tabs or buttons, that do not readily separate from the closure member upon becoming depressed due to the novel structure and arrangement of the buttons, their base portions and their frangible tear line sections, all of which contribute to a selective concentration of stresses in the frangible tear line sections during opening.

38 Claims, 26 Drawing Figures

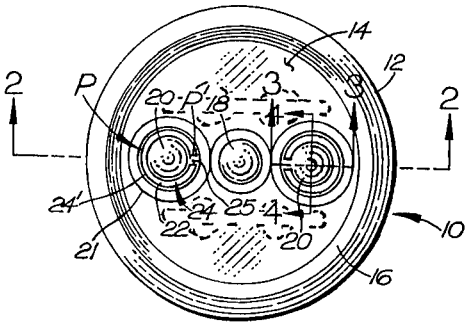
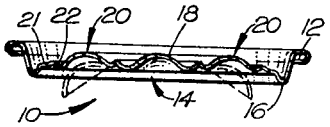
Fig-1
Fig-2
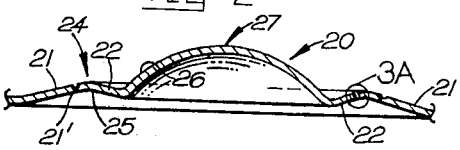
Fig-3
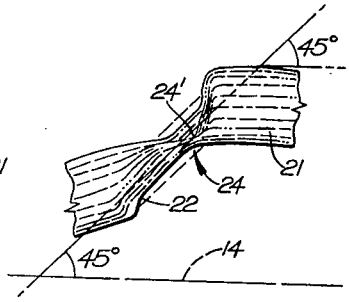
Fig-3A
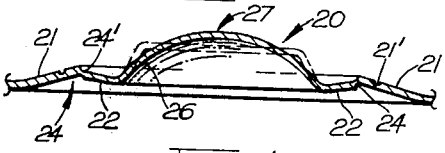
Fig-4
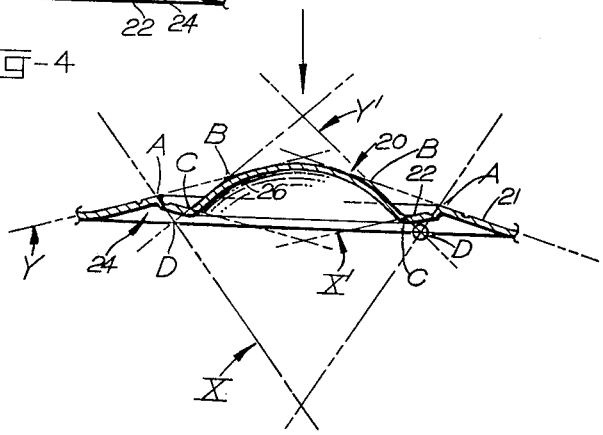
Fig-4A Station 1

Station 2

EASY OPEN END METHOD AND APPARATUS

RELATED APPLICATIONS

This is a division, of application Ser. No. 478,407, filed June 11, 1974 now U.S. Pat. No. 3,902,627, which is a continuation-in-part of my prior application Ser. No. 448,157 filed Mar. 4, 1974, entitled "Easy Open End" now abandoned. Other related applications comprise my Design applications Des. Ser. Nos. 448,096-9, inclusive, filed Mar. 4, 1974, and each of which is entitled "End Closure for a Container."

BACKGROUND OF THE INVENTION

This invention relates to easy open metal container end closures or closure members and particularly to those provided with preformed tabs that can be pushed in manually to gain access to the contents of the container to which an end closure is attached. Upon being pushed in, the instant tabs do not become readily separated from their associated end closures to become lost and thereby further contribute to the litter problem as is the case with conventional pull ring tear tabs.

At the present time, the most commonly used easy open devices for metal container closures attached to beverage cans and the like comprise metal pull rings or pull tear tabs. These rings or tabs become readily separated from their respective container closures upon opening and unless deposited in a refuse can are frequently dropped upon the ground or overboard from a boat, to form litter as well as possible hazards to marine life, or to people walking barefoot in the areas where the tabs fall upon the ground.

Not only have the separable metal pull rings or tabs created significant litter problems to the point, whereby at least one state has prohibited the use of containers provided with such rings within the state, they also involve a substantial number of precise manufacturing steps or procedures and extra metal. Since the pull ring is normally attached to a rivet formed integrally with the closure member, care must be exercised in attaching the ring to the rivet to prevent the rivet from being destroyed or weakened whereby the closure member will not pass quality control inspection during manufacture.

Attempts have been made in the past to overcome the various problems presented by the pull ring type easy open closure members by avoiding the use of such separable pull rings in favor of push button type tabs formed integrally with the closure member proper. Examples of such push button tabs for closure members are shown in U.S. Pat. Nos. 2,120,186, 2,187,433, 2,261,117, 3,362,569, 3,246,791, 3,355,058, 3,779,417, 3,760,752, 3,759,206 and Design Pat. No. 226,171, Page 9 of the "Wall Street Journal" for May 23, 1973, and the Federal Republic of Germany published (Offenlegungsschrift) Pat. application No. 2,341,077 of Apr. 18, 1974. In the easy open container closures of the last two issued United States patents, the push button opening tab is adapted during manufacture to be first completely fractured or severed from the container closure proper except for a small hinge and then pushed back into place and sealed to the container closure proper by means of an appropriate plastic sealant. These plastic sealed closure tabs, however, are difficult to make leakproof and sanitary on a mass production basis and, in any event, are still relatively expensive to produce because of the number of complex manufacturing steps and tooling involved plus the sealant materials required.

SUMMARY OF THE INVENTION

The instant easy open closure development is an attempt to overcome the problems of manufacture and use presented by prior art push button container closures of the type represented, for example, by the aforementioned patents and publications and the instant easy open container closure member is eminently adapted to be made out of a suitable ductile metal. The closure member is provided with improved easy open button-like depressible tab elements formed integrally with the metal of the container closure in such a way as not to be completely fractured or severed from the closure proper during manufacture so as to require resealing with a plastic material or the like as in the case of the closure of U.S. Pat. No. 3,759,206. Each button-like depressible tab of the closure member prior to opening effectively resists outward opening pressures generated by the contents of the container to which the closure member is attached. Yet the same depressible tabs are capable of being readily manipulated and opened with a relatively small amount of force by the finger of the user and without the requirement of any special tool. Once opened, the tab remains in the pushed-in or depressed position while the contents are emptied from the container to which the closure member bearing the tab is attached. The tab is not intended to be nor can it be readily removed from its associated container upon being depressed during opening of the container.

The improved, easy-to-open, yet internal pressure-resistant characteristics of the instant button-like depressible tabs are due to the novel structure, arrangement and angular disposition of the tabs proper and their associated base and frangible tear sections. The structure, arrangement and angular disposition of the base and tear line sections of the depressible opening tabs with respect to the other portions of the tabs and their associated closure members, such as selectively embossed portions of the closure members, provide for concentration of stresses in the frangible tear line areas of the tabs during opening and resistance to internal pressures, such as are generated by the container's contents prior to opening.

In a preferred embodiment of the invention and as will be described hereinafter, various parts of the button-like elements or depressible tabs are arranged to simulate opposed intersecting geometric cone-like figures that help to selectively distribute the stresses upon the frangible tear sections to effect fracture upon depression of the tabs and resistance to fractures from the build-up of internal pressures generated by the contents of the container provided with the depressible opening tabs prior to opening.

In a further advantageous embodiment of the invention, means are provided, such as suitable upstanding embossments somewhat analogous to those of U.S. Pat. No. 3,450,301 on the end closure member having a depressible tab of the instant invention in order to protect the tab and prevent accidental opening of the same during the usual seaming and sealing of the end closure member to a metal container, such as a beer or beverage can, as well as during other end closure handling and stacking operations.

In addition to being directed to improved metal container closures provided with the improved depressible tab elements of the instant invention, the instant invention is concerned with improved processes and improved equipment for producing such container closures, wherein the tooling and process steps contemplated are greatly simplified over those used in existing practices.

In the ensuing discussion, it is to be understood that the terms "closure member" or "end closure" as used throughout the specification and claims are meant to include closures made from all types of appropriate ductile metal materials, such as steel, tin plate, aluminum and its alloys, and other metals which are suitable for manufacturing the container closures, as well as container closures made of these metals and provided with relatively thin plastic films and coatings customarily used to protect the metal against the contents of the containers and vice versa and container closures of other than circular configurations.

BRIEF DESCRIPTION OF THE DRAWINGS

FIG. 1 is a top plan view of an improved easy open container closure member of the instant invention;

FIG. 2 is a cross-sectional view generally taken along line 2—2 of FIG. 1 and illustrates in dotted lines the normal position assumed by the pushed-in buttons or depressible tabs after they have been forced inwardly and pivoted about their respective hinge portions;

FIG. 3 is a cross-sectional view taken along the line 3—3 of FIG. 1;

FIG. 3A is an enlarged section of the frangible portion of the depressible button or tab of FIG. 3 when taken within the circumscribing line 3A of FIG. 3 and with parts added;

FIG. 4 is a cross-sectional view taken along the line 4—4 of FIG. 1;

FIG. 4A is a sectional view of a depressible tab similar to FIG. 4 wherein the various base, frangible and side wall sections of a tab are projected along hypothetical cone-like projection lines to indicate the unique opposed geometrical, cone-like relationships of the various elements making up the tab;

DETAILED DESCRIPTION

Figure 5:
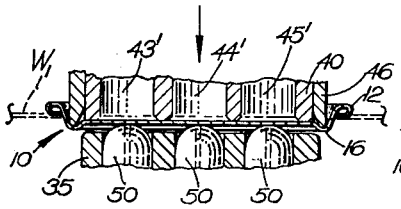
FIGS. 5 through 8 disclose various steps and tooling that can be used in producing a closure member provided with the improved depressible tabs and reinforcing embossment of the instant invention.
Figure 6:
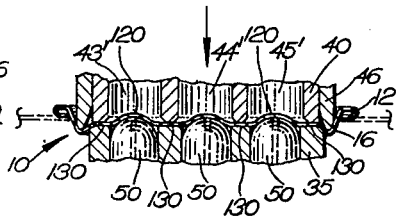

With further reference to the drawings and, in particular, FIGS. 1 through 4A, the improved container closure 10 of the instant invention is generally comprised of an outer peripherial reinforcing rim 12, which is adapted to be lock seamed in the usual fashion to the top of a container such as a beverage container and a central panel portion or area 14. Closure member 10 is further provided with the usual lower peripheral reinforcing rib 16 and an embossment 18 of appropriate configuration, such as a hemispherical or a frusto-conical configuration and which in one embodiment of the invention is disposed in the central part of panel 14.

In a preferred embodiment of the invention, located to either side of the central embossment 18 and intermediate the central embossment 18 and the peripheral rib 16 is a push button like element or depressible opening tab 20 which is operated by the finger of the user and provides access to the contents of a container provided with the closure member 10. The embossment 18 has several functions. Firstly, it reinforces and strengthens the closure member panel area 14. Secondly, it reduces the flexibility of the panel area 14 by stiffening the same thereby helping to concentrate stresses in the frangible sections of the depressible tabs 20 during opening of the same.

In the aforesaid preferred embodiment of the invention, the depressible tabs 20 can advantageously include primary and secondary substantially annular base portions 21 and 22 respectively. Base portions 21 and 22 are preferably vertically offset and at least the tops thereof are preferably horizontally offset with respect to each other as well as being concentrically arranged and interconnected by an angularly disposed web portion 24. A preferred embodiment of the invention contemplates that the inner extremity of base portion 22 merge with the bottom of the upwardly projecting wall 26 of a finger engaging dome-like section 27. This dome-like section 27 can take various forms. One embodiment of the invention contemplates that it be hemispherical or as indicated in the dotted lines in FIG. 4 it can take the form of a truncated cone.

As indicated particularly in FIGS. 3, 4 and 4A, the primary and secondary base portions 21 and 22, which have hoop-like strength characteristics, project at selected angles to each other with the primary base portion 21 being inclined generally upwardly and inwardly while the secondary base portion 22 projects in a generally inwardly and downwardly direction until it merges with the bottom of the side wall 26 of dome-like section 27.

The web 24 joining base portions 21 and 22 includes a frangible annular tear line 24' that extends in a preferred embodiment of the invention for the major length of the web 24 until it is split by and merges with the hinge portion 25. In one embodiment of the invention, hinge portion 25 can be located closely adjacent to the central portion of the panel 14 across from or in opposition to the reinforcing rib 16. The tear line portion 24' is of materially less thickness and more brittle than the adjacent base sections 21 and 22. Thus, as will be more fully described, when an inward force is applied directly to the dome-like section 27 of the tab 20 by the finger of the operator, this inward force will be concentrated in the area of the tear line 24' whereby the tear line 24' will readily fracture as stresses build up along the tear line 24'. When the tear line 24' of a tab 20 ruptures starting usually directly across from the somewhat downwardly directed hinge 25 thereof, dome-like section 27 will the pivot downwardly and inwardly about hinge 25 in the manner shown in dotted lines in FIG. 2 and without normally becoming fully separated from the closure member 10.

In an advantageous embodiment of the invention and as indicated particularly in FIG. 4A, the various inclined surfaces 21, 22, as well as the inclined web section 24', and the normal plane or slope of the wall 26 of dome section 27 adjacent its point of mergence with base 22 when hypothetically projected along the dotted lines of FIG. 4A, generate a pair of upwardly facing geometrical cone-like figures X and X' and a pair of opposing downwardly facing geometrical cone-like figures Y and Y', various ones of which ultimately intersect each other at the several spaced points A, B, C and D around the periphery of the depressible tab 20 and C being generally the point of mergence of dome section wall 26 with base 22. Projected geometrical cone-like figures X and Y' are somewhat deeper figures than X' and Y and in a preferred embodiment of the invention the apices of all the various cone-like figures are aligned.

The interrelationship of these various elements making up tab 20, e.g. base sections 21, 22, web 24 and wall 26 considered as parts of hypothetically projected cone-like figures are of significance in the manipulation of the dome section 27 and the relative ease with which the tear line 24' is fractured when a small amount of inward force is applied to the dome section 27 by the finger of the operator. Because of the thinness and work hardened characteristics of tear line portion 24' of a tab 20 plus the relationship and interaction of the opposed projected cone-like figures X, X' and Y and Y', and as previously noted a closure member embossment, e.g. embossment 18, the initial force applied by the dome-like section 27 upon an inward opening movement is translated through the inclined secondary base section 22 directly into the frangible tear line 24' where the resultant concentration of what are believed to be primarily tensile stresses force a rapid rupture or fracture of line 24'. In other words, the inward force exerted by a dome section 27 is resisted by base sections 21 and 22 then translated and rapidly converted to the aforesaid tensile stresses on the residual or tear line section 24'. At the same time, it is to be observed with reference to FIG. 4A that the point of intersection D of the bases of the hypothetical cone-like figure X projected from web 24 and opposed cone-like figure Y' projected from the normal plane or slope of wall 26 in the area of mergence of wall 26 and base 22 is somewhat below the tear line 24' whereby there is little resistance to fracture of line 24'.

In connection with another factor governing fracture of line 24', it should be noted that during the process of depressible tab manufacture, the tear line portion 24' of web section 24 is reduced substantially in cross-sectional thickness from the other cross-sectional portions of the panel area 14 of closure member 10 by virtue of the tool forming pressures exerted on web section 24 in such a way that there is preferably a bilateral pinch scoring and substantial work hardening of the web 24 in the area of tear line 24'. This work hardening results in the distorted grain structure shown schematically in FIG. 3A for the tear line 24', as the values of the relative yield and tensile strengths of this particular area 24' of the member 10 are brought relatively close together. The thinning of the metal in the area of tear line 24', while leaving the hinge 25 thicker and closer to the original thickness of the closure blank, causes a substantial reduction in the overall ductility of the material in the tear line area 24' and it becomes brittle. Thus, in the final article when relatively small tensile stresses are concentrated in tear line 24', the tear line 24' will readily fracture because of its weakened and embrittled condition.

In contrast to the relative ease with which line 24' completely fractures when an externally inward force is applied to the dome-like section 27, the angular disposition of tear line 24' relative to the base sections 21 and 22 and to the overall panel 14 together with the hoop-like strength characteristics of base sections 21 and 22, make line 24' highly resistant to stresses resulting from internal pressures such as may be generated by the contents of the can to which a closure 10 is attached.

FIGS. 5 through 8 graphically and schematically illustrate in a preferred embodiment of the invention a two-step cold working process without prior annealing utilized to initially and finally shape dimples in the closure member 10 which ultimately become the embossment 18 and depressible tabs 20 of such closure member. This two-step process can involve tooling of the type generally shown in FIGS. 5–8, when affixed to an overall die press 28 having two forming stations, and when of the general type shown in FIGS. 9–13. The closures 10, which could be previously coated with an appropriate thin plastic coating can be fed intermittently and successively from the first station to the second station of press 28 during stroking of the same in a manner well known in the art. The medium for feeding the closure members 10 to the different stations can comprise a standard and somewhat flexible metal webbing W indicated in dotted lines in FIGS. 10 and 11 and provided with appropriately spaced openings for receiving the closures and for intermittently moving in conveyor fashion a closure member 10 from the first station to the second station.

In general, the initial forming of dimples in the metal closure member panel area 14 which ultimately become the central embossment 18 and depressible tabs 20 of FIG. 1 is accomplished at the first station by selectively subjecting the panel area 14 to a plurality of bulging elements, e.g. three hemispherically shaped bulging pins or punch elements 50. Two of the initially formed dimples are then each reshaped at the second station into a central dome-like section 27, and two base sections 21 and 22 interconnected by a web section 24, made up of a tear line 24' and hinge 25.

Figure 10:
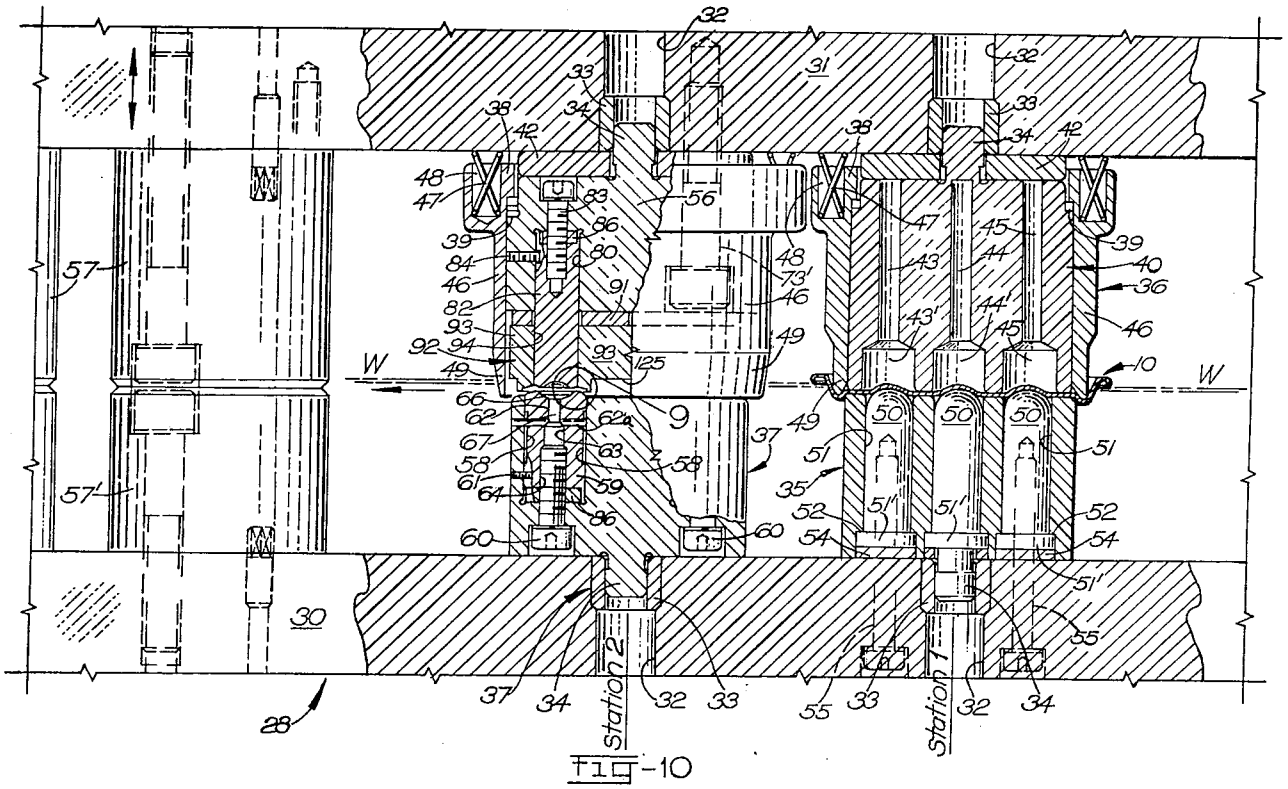
FIG. 10 is a partially fragmented sectional view of a typical press provided with the improved tools of the types shown in FIGS. 5 through 8 that can be used to produce the container closures of the instant invention.

As indicated in FIG. 10, one type of press that can be used to form the easy open closure of FIG. 1, can comprise a standard fixed base plate or platen 30 and a cooperating movable top die section 31. Platen 30 is fitted with bores 32 within which is fixedly mounted bushings or sleeves 33 for receiving the locater pin elements 34. Pin element 34 can, in the case of the lower die segment 35 at station 1, be made as part of a bulging pin 50 and as part of the bottom fixed die segment 37 in the case of station 2.

Upper die device 36 of station 1 that cooperates with bottom die segment 35 includes a movable die segment 40 provided with an upper spacer 42 and a series of counter-bored sections 43, 44 and 45 that form female die cavities 43', 44' and 45' at the lower portions thereof. Surrounding the die segment 40 is a resiliently biased centering ring 46. Upper die segment 40 is secured to movable die section 31 by means of the usual machine bolts not shown in FIG. 10 and as in the case of lower die segment 35 is provided with the usual locater stem or pin 34 that fits in the bushing 33 fitted in opening 32 of movable die section 31.

Centering ring 46 is held in place by a retainer shoulder 38 that is adapted to bottom on shoulder 39 of upper die segment 40 and ring 46 is biased relative to die segment 40 by means of the standard spring elements 47 that fit in the several cavities 48 in the upper shoulder portion of ring 46. In biasing ring 46 relative to die segment 40, the lower nose portion 49 of the ring will normally be advantageously maintained in an extended position with respect to the lower portions of die segment 40 containing the die cavities 43', 44' and 45'. Nose portion 49 of ring 46 is adapted to fit within the rib 16 of the closure member 10 and serves to hold the closure member 10 against the bulging pins 50 of the lower die segment 35 and to center the closure member relative to lower and upper die segments 35 and 40 at station 1 during the station 1 forming operation.

Pins 50 which fit in the bores 51 of die segment 35 include base sections or shoulders 51' that fit within the counter bores 52 of the pin holder or lower fixed die segment 35. If desired or necessary, suitable spacers or shim members 54 may be sandwiched in between the press bed 30 and pin holder die segment 35 prior to locking the segment 35 to the press bed by the standard machine bolts 55. When locator pin 34 is formed integrally with a bulging pin 50, the shim 54 for such pin 50 should be apertured as noted in FIG. 10. It is to be noted that the overall press apparatus 28 is equipped with the usual cooperating bottom and top stop elements 57 and 57', which selectively limit the movement of the movable press punch portion 31 relative to the fixed base 30.

Station 2 of press 28 is provided with a die set comprised of lower and upper die set segments 37 and 56. Fitted within each of the twin bores 58 of lower die segment 37 is a die insert 59 that is held in place by a main bolt 60 and a side pin 61. Since each die insert 59 is similarly constructed and configured, a description of one will suffice for both. Die insert 59 is provided with a plurality of aligned bores 62, 63 and 64. Bore 62 communicates at the bottom with air holes **62*a* and leads at its top to a generally inverted frusto-conical surface 66 while bore 64 is threaded and adapted to receive machine bolt 60 used to anchor insert 59 to die segment 37** in the usual fashion.

Figure 7:
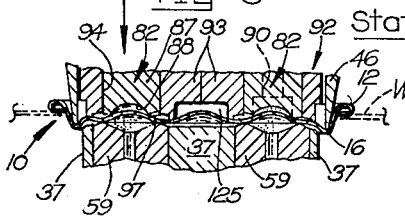
Figure 8:
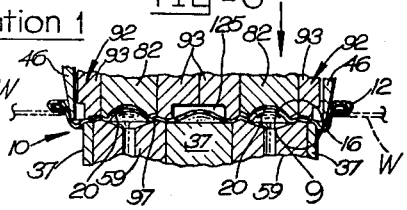
Figure 9:
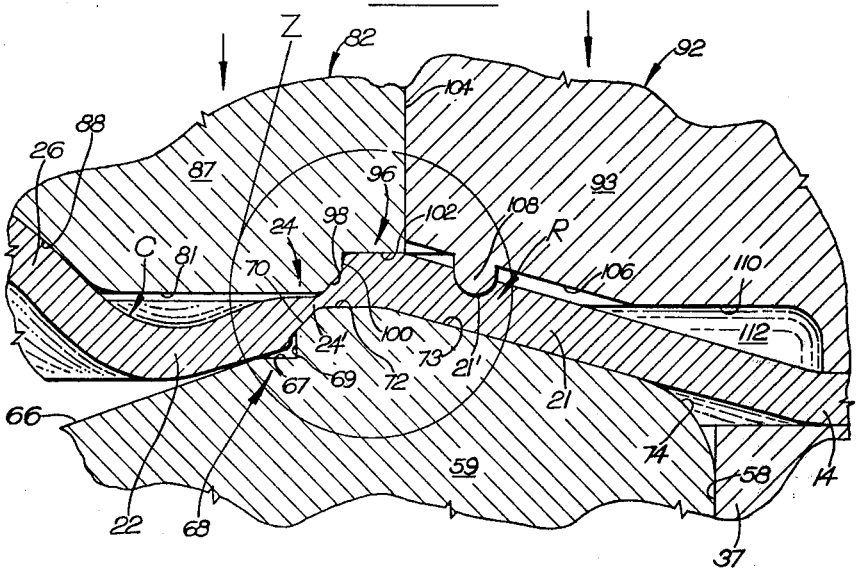
FIG. 9 is an enlarged cross-sectional view taken with the circumscribing line 9—9 of FIGS. 8 and 10 and discloses the manner in which the tools produce the improved frangible tear line section of a depressible tab for the container closure of the instant invention.

With further reference to FIGS. 5–10 and especially FIG. 9, the outer edges of inverted frusto-conical surface 66 merge with the annular stepped shoulder portion 68 of the die insert 59 that is of particular significance in forming the web portion 24 including the tear line 24' of a depressible tab 20. As indicated in FIG. 9, stepped shoulder portion 68 is comprised in vertical cross-section of small flat base 67, a vertical wall 69 that merges with the upwardly and outwardly inclined surface 70 followed by flat crest 72 that merges with a further downwardly and outwardly inclined die surface 73. The outer edge of die surface 73 is followed by a gentle arc 74 that terminates at the vertical wall of the die insert 59. During forming and as indicated particularly in FIG. 9, the outermost portion of tab base 21 along with the outermost part of panel 14 is supported by the peripheral top area of die insert 59.

The upper die segment 56, which as shown in FIG. 9, cooperates with a lower die segment 37 at station 2 is likewise fitted to movable die plate 31 by a stem or pin 34, etc. in the same fashion as lower die segment 37 is attached to the bed 30. Die segment 56 is encompassed in the same fashion as upper die segment 40 at station 1 by a centering ring 46 and related parts similar in structure and function to the centering ring 46 for die segment 40. Die segment 56 can also be fitted with a shim or washer 42 and is attached to die plate 31 such as by the bolts 73'.

Die segment 56 is provided with twin bores 80, only one of which is shown, for receiving the die inserts 82 which cooperate with their associated lower die inserts 59 to finally shape and form the depressible tabs 20 and associated parts of panel 14 and embossment 18 of the closure member 10. Since both die inserts 82 are similarly constructed a description of one will suffice for both.

Die insert 82 is locked in place in bore 80 in a conventional manner by a machine bolt 83 and a locating and turn resistant pin 84. Shim elements or spacers 86 may be used in the insert holders or bores 80 for the purpose of obtaining the proper seating of the die inserts 82 in their respective bores 80. Similar spacers 86 can be used in the case of lower inserts 59. The nose portion 87 of an insert 82 is provided with a hemispherical type die cavity 88 for receiving, as indicated particularly in FIGS. 7–10 of the drawings, the initially formed dimple that later is to become the dome-like section 27 of the depressible tab or button 20.

Cavity section 88 is of smaller peripheral dimensions than surface 66 and opposes the inverted frusto-conical surface 66 of a lower die insert 59 while cooperating with surface 66 to finally shape a tab 20 as will be hereinafter described. Affixed to the lower portion of die segment 56 by appropriate machine bolts 90 shown in dotted lines in FIG. 7, for example, and separated from the main portion of die segment 59 by spacers 91 is a split insert guide and protective plate 92. The segments 93 that make up plate 92 are provided with openings 94 alignable with the openings 80 for receiving the nose portion 87 of die insert 82.

The lower section of hemispherical cavity 88 as indicated in FIG. 9 terminates in or is bounded by an annular flattened surface 81 followed by an annular stepped shoulder section 96. Shoulder section 96 is of particular significance in that it cooperates during bottoming of the various die elements at station 2 with the opposing stepped shoulder section 68 of the die insert 59 in the forming area Z shown in dotted lines in FIG. 9 to form the web section 24 of the depressible tab 20 made up of frangible tear line 24' and hinge 25. In this connection it is to be noted that an appropriate area of shoulder section 96 is hollowed out or notched as at 97 in FIGS. 7 and 8 to form the generally downwardly directed tab hinge 25 at the same time tear line 24' is formed.

Shoulder section 96 in vertical cross-section includes an upwardly and outwardly inclined surface 98 followed by a short vertical wall 100 that merges with a flat surface 102 disposed at an appropriate angle to wall 100. Surface 102 merges with the vertical wall 104 of the nose 87 of die insert 82. Also located in the forming area Z is the somewhat conically shaped lower downwardly and outwardly inclined surface 106 of the nose guide segment 93. An annular rib 108 can project downwardly from an intermediate part of surface 106. The outer periphery of surface 106 merges with the wall 110 of the pocket 112 in the nose guide segment 93. All of the aforesaid elements of a die insert 82 and a guide or plate segment 93 including in particular rib 108 of segment 93 act during the stroke of the press 28 in conjunction with the tops of a die insert 59 and die segment 37 to finally shape the bases 21, 22, web 24, including its tear line 24', and hinge 25 and dome section 27 of a tab 20 including the annular recess 21' in the base 21.

Figure 11:
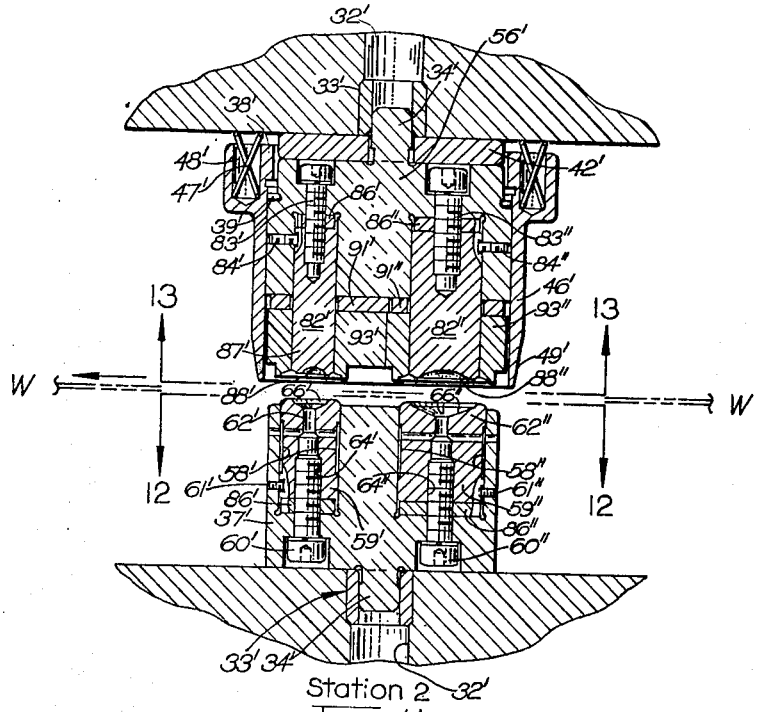
FIG. 11 is a sectional view of a modified form of tooling that can be used to produce a modified form of closure member according to the instant invention.
Figure 12:
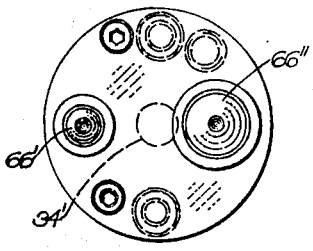
FIG. 12 is an end view of the fixed die part of the tooling taken along line 12—12 of FIG. 11.
Figure 13:
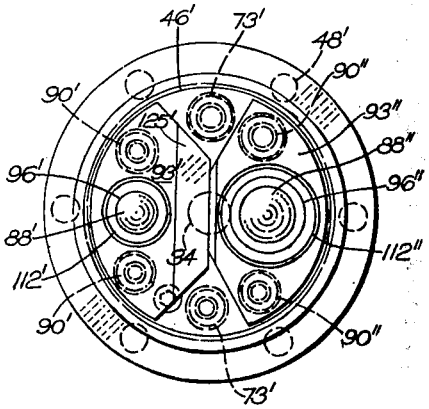
FIG. 13 is an end view taken of the movable die portion of the tooling taken along the line 13—13 of FIG. 11.

With further reference to the drawings, FIGS. 11 through 13 disclose a modified set of station 2 tools that could be used in lieu of those shown in FIG. 10 in the event the use of different diametrically sized depressible tabs or buttons 20 are desired in the final closure member 10 in addition to a reinforcing embossment 18. In the case of the tools of FIGS. 11–13, since the die inserts and related parts are similar to those of FIG. 10 except for size, prime numbers, to the extent practical, are used for all elements except the larger die inserts and directly related elements which are identified by double prime numbers. It is also to be understood, of course, that where different sized depressible tabs 20 are to be produced the die cavities 43' and 45' and cooperating pins 50 of the tooling at station 1 will also require a corresponding change in size and location and a substitute set of tools. Where different sized tabs 20 are produced, the location of the embossment 18 will ordinarily require special tooling considerations over the tools shown in the drawings in that the embossment should be offset relative to the center of panel 14, while still being located preferably equidistant from the innermost adjacent edges of each different sized tab. Thus, there would be, of course, a suitable relocation of die cavity 44' along with the aforedescribed changes in size and location of die cavities 43' and 44' in the tooling at station 1.

The process for forming an improved closure member of the instant invention will now be described with particular reference to making a closure having tab designs of the type shown in FIG. 1 in a two step or two station process using tooling of the type shown. A two step process is preferred because it minimizes the necessity of severe forming or cold flowing of the metal in a single operation with possible fractures and multiple rejects. Accordingly, in a preferred embodiment of the invention, it is contemplated that the end closures 10 be fed from one station to another of the press 28 by being passed across and between the opposing upper and lower die elements of each station 1 and 2 and with sufficient dwell time being allowed at each station for the respective die elements to perform the particular forming steps desired. Thus, for example, see FIG. 5, this could be done by using a web W of metal material with appropriate openings and with the individual end closures 10 being fitted inside of the openings and then moved across the dies along the path shown, for example, in FIG. 10.

As each closure member 10 moves between the upper and lower die segments 40 and 35 at station 1, it would be initially engaged on the downward stroke of the press by the nose tip 49 of station 1 centering ring 46 as the nose tip fits within the rib 16 of the end closure 10 and acts to center the closure member with respect to the bulging stationary pins 50 of the lower die segment 35 (see FIG. 5). As the die segment 40 continues to move down pins 50 and the bottoms of the walls of the various female die cavities 43', 44' and 45' engage the panel portion 14 of the end closure 10 and act to draw or force the several selected areas of panel portion 14 to move or bulge slightly upwardly into the die cavities 43', 44' and 45' to form the shallow central embossment 18 and side buttons or dimples 120 of FIG. 6. All of this takes place with controlled cold flowing of the metal and with but negligible or minimal stretch forming or thinning of the metal in all of the dimple and embossment wall structures except at the crests or the extreme top portions of the dimples and embossments and even then such thinning is minimal.

Thus, for example, if the starting material or end closure 10 of an approximately 2 7/8 inches diameter were made of a readily ductile and workable aluminum alloy of the appropriate hardness or temper such as a 5182 aluminum alloy, the number designated for the same by the American Aluminum association, and of about a ¾ hard temper, e.g. H26 temper and of an initially 0.013 inch thickness or gauge, the reduction in the thickness during the first forming step of the central embossment 18 and side dimples 120 may at the most be on the order of about 0.002 inch and then substantially all such thinning taking place in the crests of the dimples 120 and embossment 18.

During this initial shallow forming, the dimples and embossment all are formed in a symmetrical fashion and in the case of where similarly shaped and sized dimples 120 for final depressible side button-like elements 20 are used, they are preferably spaced equidistant from and on either side of the centermost embossment 18 as they are subjected to the relatively gentle outward bulging or draing pressures of pins 50. After the initial formation of the shallow dimples 120 and embossment 18, which could all have heights on the order of about 5/64 inch and with bases having diameters on the order of about ½inch, the closure 10 is released from the die elements of station 1 in a manner well known in the art as press 28 opens and then passed by conveyor web W on to the die set of station 2 as an additional end closure 10 is introduced simultaneously to the die set at station 1 so that it can be initially worked simultaneously with the reworking of the first mentioned die closure now at station 2.

When the partially formed end closure 10 enters station 2, it is initially engaged by the spring biased centering ring 46 for station 2 which surrounds the upper die segment. Centering ring 46 of station 2 upon its nose portion becoming seated in the rib 16 of the end closure 10, when press platen 31 moves down, operates to center and hold the end closure with respect to the tool elements at station 2. Thereafter, as the tooling edge portions of the top die segment 56 move down and into full contact with the panel section 14 of the end closure 10, the partially formed embossment 18 fits freely within the central cavity portion or space 125 of the upper die segment of nose elements 93 and between die inserts 82, where it remains relatively undisturbed during the further working and reshaping of the outermost peripheral portions of the side dimples 120 to form the generally concentric outer and inner tab base portions 21 and 22, etc. and final tabs of, e.g. about ¾ inch diameters and 3/32 inch heights. With reference to FIGS. 7, 8 and 9, as the upper die segment 56 at station 2 moves downwardly and with the initially formed central embossment 18 fitting within the space 125, the areas of panel section 14 constituting the original bases 130 of the dimples 120 (see FIG. 6) are subjected to the controlled and progressive forming pressure of the tooling of station 2 into the primary and secondary base sections 21 and 22 joined together by the web sections 24 made up of the thinned split tear lines 24' and tab hinges 25 into which the split ends of lines 24' merge. As this reshaping and stretch forming of the metal in the panel 14 takes place to form base and web sections 21, 22 and 24 of the final tabs 20, the upper parts of the outermost dimples 120 deflect upwardly a small amount and assume the general hemispherical configuration of the upper die cavity 88, but without in a preferred embodiment of the invention becoming locked to the wall of cavity 88. In the final closure structure the preferred embodiment of the invention contemplates that the tab dome section 27 and embossment 18 should be relatively shallow and project somewhat below the top plane of rim 12 to preclude stacking problems, accidental tab openings, etc.

The severest forming and controlled cold working of the metal in panel section 14 of end closure 10 at station 2 takes place primarily in the area or zone designated by the letter Z in FIG. 9, while the upper portions of the dimples 120 are allowed to be deflected or displaced freely and slightly upwardly into their associated die cavities 88 without substantially any further thinning taking place in the wall 26 proper of the originally formed dimple 120 and finally shaped dome section 27. Whatever thinning takes place in a tab wall 26 occurs primarily during the original bulging in station 1 and then primarily in the very top or crest of a dome section 27 and embossment 18, all as aforementioned. During the operation at station 2 where web area 24 is thinned there is substantially no thinning of the metal in the areas of panel 14 that are cold worked into most of base 21 and all of base 22. Thus, with the exception of the web area 24, a relatively minor part of the base 21 shaped by rib 108 and the crest of a dome-like section 27 a finally shaped depressible tab 20 has almost the same thickness as the original thickness of the starting end closure blank 10 prior to its being worked and reworked at stations 1 and 2.

In the cold working operation that takes place at station 2, the metal of panel 14 making up the tear line section 24' of web 24 is subjected to tool pressure from both sides and becomes substantially thinner than the remaining portions 21, 22 and 26 of the final tab 20. For example, the web section 24 with the exception of hinge 25 is severely cold worked from both sides and substantially reduced in thickness such that in the case of the closure 10 having an original blank thickness of 0.013 inch, the frangible tear or residual line 24' of web 24 could be thinned to between 0.003 inch and 0.0015 inch thickness or to as low as less than one-eighth of the original thickness of such end closure blank without fracture during forming.

During the same time, the metal of the tear line section 24' is subjected to the compressive action of the tooling in the area Z of FIG. 9, it is substantially work hardened and embrittled as aforedescribed by virtue of the compressive action of the tools in contrast to the adjacent base sections 21 and 22 formed integrally with web section 24 and tear line section 24'. During the cold working and thinning, tear line section 24' is, as indicated in FIG. 3A, also oriented preferably at about a 45° outside or exterior angle to the normal plane of the panel portion 14. Since the frangible web section 24' is advantageously formed by opposing indentations or bilateral scores on each side of the metal, this has the advantage of controllably cold flowing the metal in a substantially uniform fashion away from the web section 24 on both sides of the metal closure and along the entire length of tear line or residual section 24' of section 24. This also helps to minimize locking of the metal in the dies and the formation of localized or pin hole type weakened areas in the tear line section 24' which might later break prior to the time opening is desired and cause undesirable leakage of the end closure during use or otherwise interfere with the desired easy opening of tab 20.

In order to help control the cold flow of metal and particularly the excess metal of web 24 that builds up in area Z and to direct it away from web section 24' and toward the interior of cavities 66 and 88, the lower inclined wall 106 of a nose guide segment 93 adjacent shoulder section 98 can be provided with an annular rib 108 that impresses the small shallow annular depression 21' in base 21 and acts as a dam to retard and prevent excessive cold flow of metal outwardly away from lower and upper tooling shoulder sections 68 and 98 and the metal tear line section 24' of a tab 20 during the formation of the same. At the same time, metal in the zone R in the base 21 will form a band of more work hardened metal than in other parts of base 21. The depth of the depression 21' can be controlled by the vertical length of the rib 108 and/or the amount of final downward movement of nose element 93 relative to die surface 73. Likewise, the final thickness of residual section 24' is determined by the amount of downward movement of nose 87 of die insert, e.g. insert 82, relative to cooperating die insert 59 and all of which can be somewhat greater or lesser than is illustrated in FIG. 9.

As noted above, the embrittlement of the frangible tear section 24' by virtue of the aforesaid cold working shaping and reshaping particularly at station 2 means that this area of the tab 20 will be susceptible to being readily fractured with but a relatively small inwardly directed force applied to dome section 27 of the finished tab 20. In addition to the easy open features resulting from the use of a bilateral score or a thinning of the metal in web tear section 24', there is another advantage that occurs during opening of a tab 20. This concerns the fact that when the score line 24' is ruptured it tends to fracture without leaving any residual burr-like materials on the outside of the closure member 10 in the area of the tab opening that might be injurious to the operator's fingers.

Although the preferred embodiment of the invention contemplates that the frangible annular tear line would be of substantially the same thickness for its entire length, e.g. the 0.003 inch thickness in the example given above, the thickness of the tear line 24' might be slightly tapered along its length by the use of suitable tools as indicated in dotted lines in FIG. 3A. Thus, it could be slightly thinner, e.g. 0.002 inch thickness, at the point directly opposite or across from the hinge 25, such as the point P of FIG. 1, than at any other point along its length and thickest at the points P' adjacent either side of hinge 25.

After bottoming of the die set at station 2 and final formation of closure 10 are completed, the die 28 is opened and die segments 37 and 56 separated. After the closure 10 with its fully finished tabs 20 and embossment 18 is moved out of station 2 it is then transferred to a further processing station in the line by the conveyor web W aforedescribed.

In a further advantageous embodiment of the invention, it is contemplated that appropriate upstanding embossments be provided in the panel portion 14 to protect the various depressible tabs 20 from being accidentally opened, particularly when end closures bearing such tabs are lock seamed by the usual container end seaming tools to the open end of a container, such as a beverage container, as well as during other end closure mechanical handling or stacking operations, etc. In order to provide such protection, the end closure to be described is advantageously provided with protective as well as stiffening embossments of a greater height than the height of the depressible tabs, but of less height than the end closure rim. In one embodiment of the invention, such embossments are located adjacent the central panel portion of the end closure. These embossments are adapted to be engaged by the striper elements of a standard can end seaming tool during stripping of the sealed and seamed container from the seaming tool rather than the push button tabs to preclude accidental opening of the latter. These same embossments may, if desired, be combined with or made part of further embossments also utilized to stiffen and reinforce the lid or end closure member per se in an improved fashion.

Figure 14:
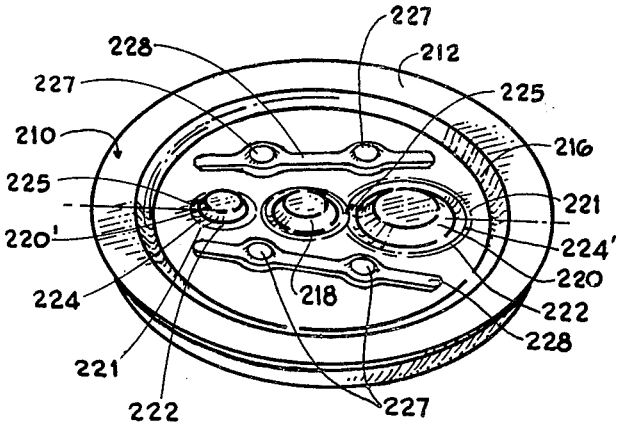
FIG. 14 is a perspective view of a further modified form of end closure of the invention provided with at least one depressible tab and reinforcing and protective upstanding embossments.
Figure 15:
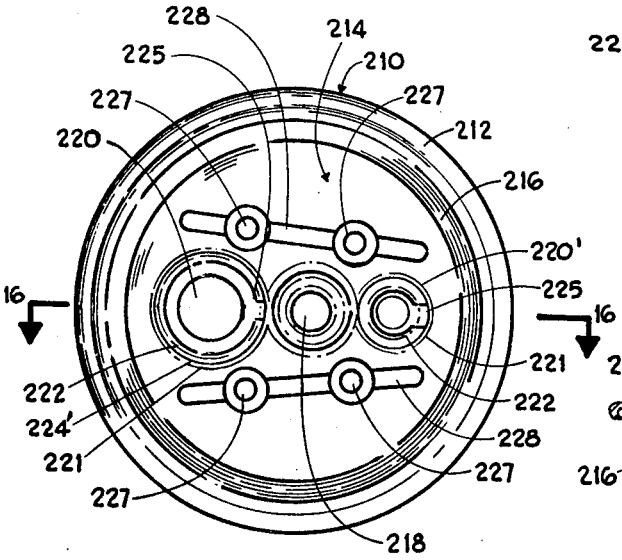
FIG. 15 is a top plan view of the end closure shown in FIG. 14 when rotated 180°.
Figure 16:
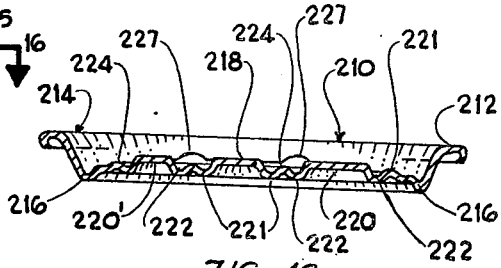
FIG. 16 is a sectional view taken along line 16—16 of FIG. 15.

An end closure 210 provided with such improved upstanding embossments is illustrated in FIGS. 14 through 16. End closure 210 can be fabricated by means of the station 1 tooling disclosed in FIGS. 17 through 23 and to be described as well as the general station 2 tooling shown particularly in FIGS. 9 and 11 through 13. Since the tooling of FIGS. 17–23 is to be used at station 1 and with the overall press 28 of FIG. 10, it is to be understood that end closures 210 will be fed to press 28 equipped with the tooling of FIGS. 11–13 and 17–23 in the same fashion as previously described, such as by means of a web W having openings within which the end closures 210 fit.

With further reference to the drawings and, in particular, FIGS. 14 through 16, an end closure 210 is comprised of the usual outer peripheral reinforcing rim 212, which is adapted to be lock seamed in a conventional fashion to the top of a container, such as a beverage container, and a central panel portion or area 214. Panel area 214 is provided with the usual and at least one peripheral reinforcing rib 216 and a central embossment 218 of apropriate configuration, e.g. a shallow frusto-conical configuration. In the embodiment of the invention as shown in FIGS. 14 through 16, embossment 218 is somewhat offset from the central axis of the end closure 210 due to the different relative sizes and location of push button tabs 220 and 220'.

Figure 24:
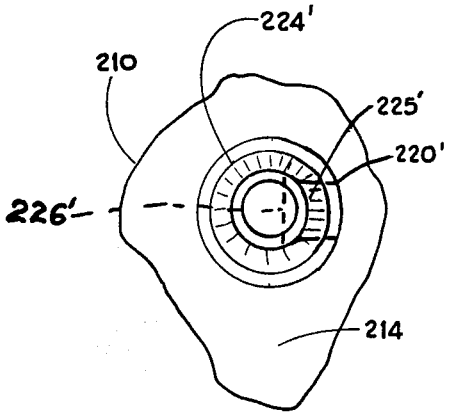
FIG. 24 is a fragmentary and enlarged plan view of the smaller push button tab of the end closure of FIG. 15 and discloses a modification thereof.

The larger size push button tab 220, can be the depressible tab used for pouring the contents of the container, while the smaller depressible tab 220', which is adapted to be opened first, is utilized to relieve the pressure from inside the container, is utilized to relieve the pressure from inside the container, when the container is used to merchandise beer or a carbonated beverage, etc. The position and function of embossment 218 is similar to that previously described with respect to embossment 18 of the enclosure of FIG. 1 while each of the depressible tabs 220 and 220' is likewise provided with improved base portions 221 and 222 corresponding to and generally similar in structure and function to previously described base portions 21 and 22 respectively for end closure 10. Base portions 221 and 222 are offset with respect to each other as previously described as regards their counterpart base portions 21 and 22 in closure 10 as well as being concentrically arranged and interconnection by an angularly disposed web portion 224. Web portion 224 is similar in structure and function to the previously described and angularly disposed web portion 24 of end closure 10. Thus web 224 includes a frangible tear or residual line 224' that can extend for a substantial part of web 224 and a hinge 225, all of which are generally similar in structure and function to the previously described residual tear line 24' and hinge 25 of the tabs 20 of FIGS. 1 through 4A. In the present instance, however, hinge 225 is shown as being located in the case of the larger depressible tab 220 closely adjacent to the central embossment 218, while the hinge 225 of the smaller depressible tab 220' is shown as being located more closely adjacent the peripheral rib 216 rather than the intermediate embossment 218. The hinge for convenience of manufacture may also be substantially aligned with each other. Further, a given hinge 225 can be of a longer dimension than is illustrated in FIG. 1. For example, a push button tab such as the smaller tab 220' as indicated in FIG. 24 can have a relatively large hinge 225' of a substantial arc, e.g. 120° to 140', and with the frangible or residual part of the tear line 224' comprising a substantial and even a major part of web 224, e.g. an arc of 220° to 240', so that somewhat more than about one-half of tab 220 can be depressed along the bend line 226' of tab 220' and about hinge 225 in FIG. 24 to relieve pressure built up inside the container provided with an end closure of the invention.

Thus, excpet as noted and except for their different relative sizes and particular frusto-conical shapes, the tabs 220 and 220' as well as the embossment 218 can have the same basic configuration, structure and function as the press button tabs 20 and embossments 18 previously described with respect to the end closure of FIGS. 1 through 4. A primary difference, however, between end closures 10 and 210 resides in the upstanding protective embossments 227 that can be formed separately or as part of the upstanding bar or rib-type embossments 228, which in the end closure embodiment of FIGS. 14 through 16 can be arranged in a converging fashion and on opposite sides of tabs 220 and 220'. The height of embossments 227, which can take various shapes, e.g. hemispherical or bead-like as shown in FIGS. 14–16, should be greater than the heights of both tabs 220, 220' and embossment 218. In addition to serving as a base for the secondary and protective embossments 227, the rib embossments 228 provide for further stiffening of the panel closure area 214, whereby it is less susceptive to being deflected improperly or adversely during the depressing and opening of tabs 220 and 220'. Instead of converging in the fashion shown in FIGS. 14 and 15, the reinforcing and protective embossments 227 and 228 may be arranged in the parallel fashion shown in dotted lines in FIG. 1.

The tooling for fabricating the end closure of FIGS. 14 through 16 includes, in addition to the station 2 tooling of FIG. 11 through 13, the modified tooling of FIGS. 17–23 used at station 1 of press 28. In a preferred embodiment of the invention the tooling of FIGS. 17–23 can comprise lower and upper die segments 235 and 236. Lower die segment 235 is secured by the machine bolts 55 of FIG. 10 in the usual fashion to the fixed platen 30, while upper die segment 236 is connected by suitable machine bolts (not shown) to the movable die section 31 in the same fashion, in effect, as the upper die segments 36 are removably connected to the top die section 31. The lower die segment 235 is provided with a locating stem or pin 237 that is removably mounted within the bushings 33 fitted in opening 32 of the fixed die section 30. The locating stem or pin 237 can comprise the lower part of and be formed integrally with central punch or bulging pin 238 used to bulge or initially form the embossment 218.

Figure 17:
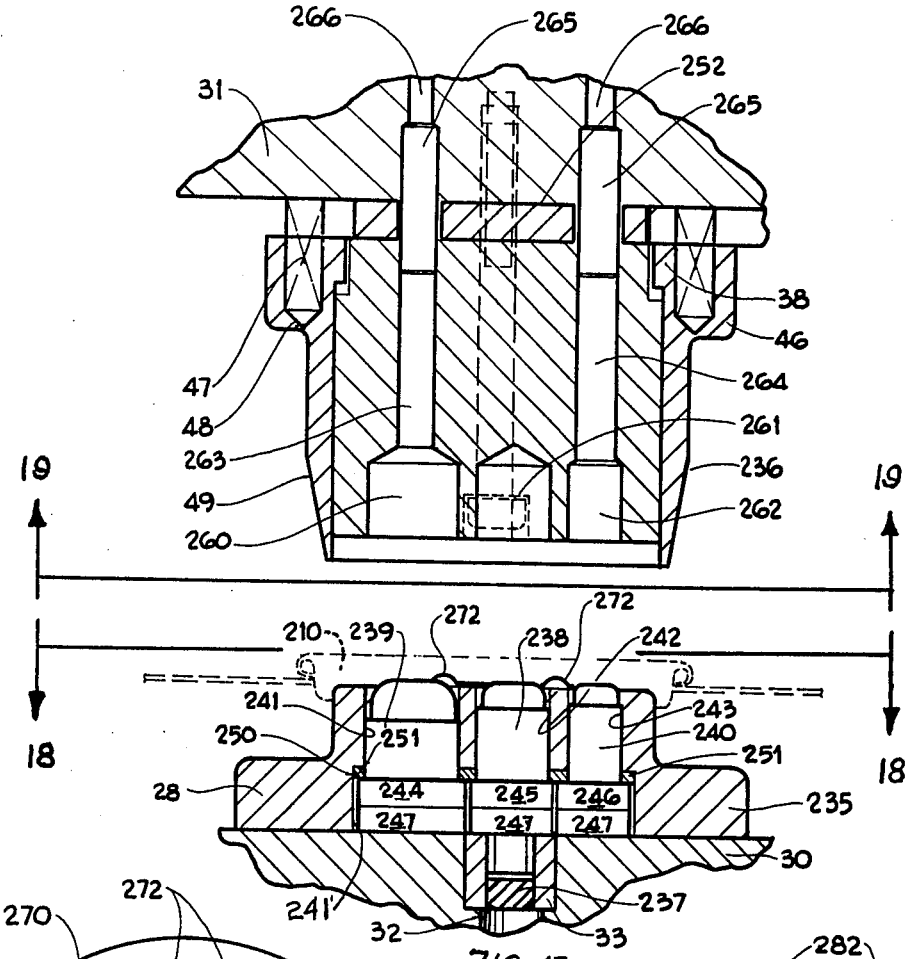
FIG. 17 is a fragmentary sectional view of a modified form of tooling shown in an open position and which can be used along with the tooling of FIGS. 9, 11–13 to produce the modified type of end closure shown in FIGS. 14–16.
Figure 18:
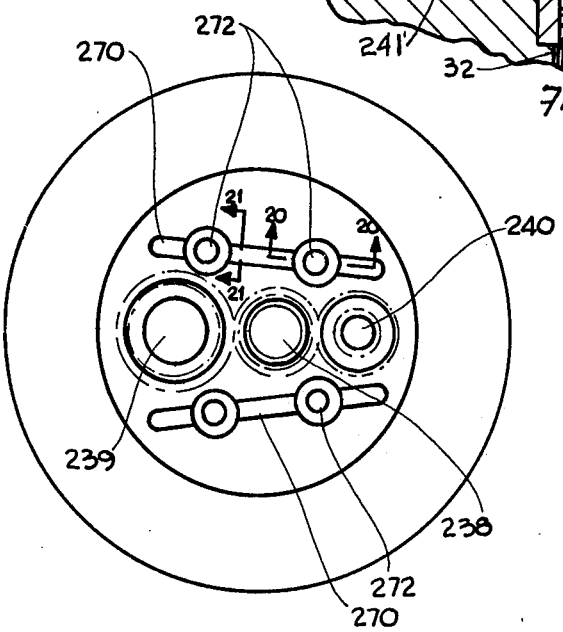
FIG. 18 is an end view of the fixed die part of the tooling of FIG. 17 when taken along line 18—18 thereof.

Punch 238 along with other differently sized punches 239 and 240 fit within the bores 241, 242 and 243 of the punch holder making up the lower fixed die segment 235. Formed integrally with the punches are the shoulder elements 244, 245 and 246 on the respective punches 239, 238 and 240 and these shoulder elements fit within the overall counterbore 241'. If desired, or necessary, spacers or shim members 247 may be sandwiched in between the press bed 30 and the punch holder die segment 235 prior to locking the segment 235 to the press bed by the standard machine bolts 55. When the centering pin 237 is formed integrally with a punch 238, the shim 247 therefor should be apertured as indicated in FIG. 17. The punches or pins are held within the pin holder 235 by virtue of the shoulder element 250 of the counterbore 241' and, if desired, shim elements 251 may be located intermediate the shoulder 250 and the shoulder sections 244, 245 and 246 of the various pin elements.

Along with punches 238, 239 and 240, the lower die segment 235 is provided as indicated in FIGS. 17, 18, 20 and 21 with a pair of raised and elongated rib or bar-like surfaces 270 arranged in a somewhat converging fashion and in one embodiment of the invention extending for a substantial distances across the bottom of the die in order to provide or form the raised embossments 228 on the end closure 210. The height of these bars 270 can, if desired, be equal to or slightly less than the height of the punches 238, 239 and 240. At appropriate spaced points along each of these bar elements or a similar raised element is one or more beads or button heads 272 of an appropriate shape, e.g. hemispherical or frusto-conical, etc. The height of these button heads 272 which form the protective embossments 227 in the final end closure 210 should be higher, e.g. on the order of ten to twenty thousandths of an inch higher, than the tops of the individiaul punches 238, 239 and 240.

The hemispherical or arcuate segments 272 in one embodiment of the invention can all be located at the same distance or at the same radius from the main center of the die segment 235 in order to form protective embossments 227 that are located at points on the same circle drawn from the center or central axis of end closure 210 and which would come into contact with the seam tool pushout during the seaming of the closure member 210 to a standard sized beverage can.

Figure 20:
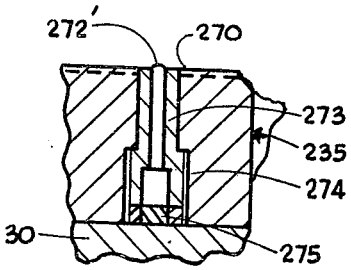
FIG. 20 is a sectional view taken along line 20—20 of FIG. 18 with parts removed.

Although beads 272 can be formed integrally with a raised rib 270, they can also be made in the form of a removable pin 272', all as indicated in FIG. 20. This pin is adapted to removably fit within an outwardly stepped sleeve holder 273 and the sleeve holder 273 is removably fitted within a stepped bore section 274 located in the appropriate portions of the die segment 235. As in the case of the pin elements 239, 238, and 240, appropriate spacer or shim elements 275 may be located intermediate the sleeve 273, the pin 272' and the fixed platen 30 at the time the lower die segment 235 is removably affixed to platen 30.

Cooperatively associated with lower die segment 235 at station 1 is the upper die segment 236. Die segment 236 includes an apertured upper spacer member 252 sandwiched in between the upper die segment 235 and the movable top die section 31. Die segment 236 is adapted to receive the centering ring 46 previously described and held in place by a retainer shoulder 38, while being biased relative to the die segment 236 by means of the standard spring element 47 fitted in separate cavities 48 in the upper shoulder portion of ring 46, all as previously described. This biasing or centering ring 46 with its nose portion 49 is usually maintained in an extended position with respect to the lower portions of the die segment 236. The nose 49 of ring 46 is adapted to fit within the rib 216 of the closure member 210 in order to initially center this closure member relative to the lower and upper die segments 235 and 236. In addition, the centering ring as in the case of the previous dies operates to hold the closure member 210 against the several bulging punches or pins 238, 239 and 240 of the lower die segment 235 and to maintain the desired centering of the closure member relative to the lower and upper die segments 235 and 236 at station 1 throughout the forming operations that take place at this station.

The upper die segment 236 further includes as indicated in FIG. 17 the main die cavities 260, 261 and 262 which cooperates respectively with punches 239, 238 and 240 to initially form the tabs 220, 220' and embossment 218. Die cavity 260 can be formed as a continuation or enlargement of a main bore 263 while cavity 262 can be made up of a continuation or enlargement of a bore 264. In one advantageous embodiment of the invention, the upper part of the bores 263 and 264 may be adapted to receive die segment locating or centering pins 265, which also protrude through appropriate openings in the shim member 252 and with the centering pins 265, if desired, comprising the lower sections of pin elements 266 that extend through appropriate openings in and are locked to the upper movable die sections 31 in a manner well known in the art.

Figure 23:
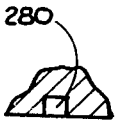
FIG. 23 is a sectional view taken along line 23—23 of FIG. 19 with parts removed and also rotated approximately 180°.
Figure 22:
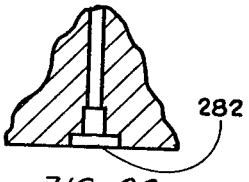
FIG. 22 is a sectional view taken along line 22—22 of FIG. 19 with parts removed and rotated approximately 180°.
Figure 21:
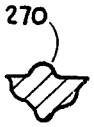
FIG. 21 is a sectional view taken along line 21—21 of FIG. 18 with parts removed and somewhat enlarged.
Figure 19:
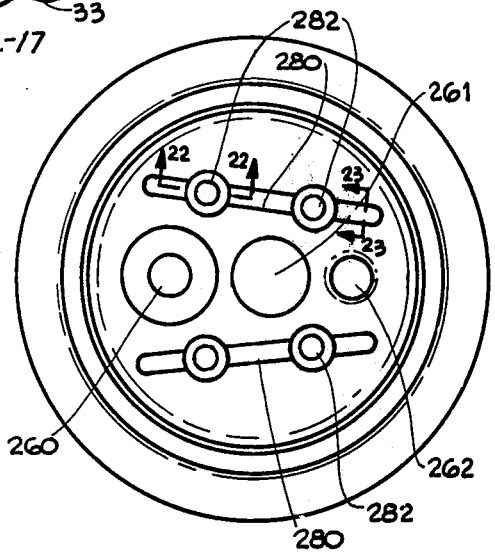
FIG. 19 is an end view of the movable part of the tooling of FIG. 17 taken along line 19—19 thereof.

Die segment 236 is further provided as indicated in FIG. 19 with elongated and converging rib-like cavities 280 of the type indicated in FIGS. 19 and 23 that are adapted to cooperate with ribs and beads 270 and 272. Appropriate parts of these cavities 280 can be further hollowed out or provided with counterbored sections as indicated in FIGS. 19 and 22 so as to provide the enlarged openings 282 for receiving the pin elements 272' along with that portion of panel 214 of the end closure member 210 which is to be formed into the protective and raised embossment 227 in a manner to be hereinafter described. The stepped counterbores 282 are formed along with the elongated cavities 280 in the upper die segment 276, all in a manner well known in the art.

THe second station tooling elements disclosed in FIGS. 9 and 11 through 13 can be advantageously used along with the station 1 tooling elements of FIGS. 17 through 23 to form the final closure member 210. Because of the construction and arrangement of parts of such station 2 tooling of FIGS. 9 and 11–13, sufficient clearance will be provided in the various parts of the upper die segment 56' and its associated die inserts 82' and 82'' as well as the guide and protective plate 92 to accommodate with adequate clearance the raised sections 227 and 228 on the closure member 210 formed at station 1. Further, since these raised sections 228 and 227 are completely formed at station 1, there is no need for any further treatment of these parts of end closure 210 at the second station.

The only further treatment of the end closure 210 that takes place at the second station by way of the tooling of FIGS. 11–13 and 9 is the final formation of the base sections and the tear line elements, etc. for the individual push button tabs 220 and 220' and which can be basically the same as in the case of the closure member of FIGS. 1–4A, all as aforementioned.

The process used in the final formation of the end closure 210 at stations 1 and 2 can be basically the same two-step process previously described except for the formation of the protective embossments. In the bulging or drawing operation, which takes place at station 1 during the downward stroke of the press, the various punch elements operate to move or draw the metal of the flattened area or central portion 214 of the end closure upwardly into the differently sized die cavities 260, 261 and 262. All of this takes place with a controlled cold flowing of the metal and without any significant or noticeable thinning of the metal taking place in the various parts of the dimples and the various wall structures except possibly for the thinning of the crests or the extreme top portions of the dimples or embossments in an amount not exceeding one or two thousandths of an inch of metal.

After the initial formation at station 1, the height of various shallow dimples that are formed by means of the tooling of FIG. 17 to later become tabs 220 and 220', could be on the order of 0.070 inch plus or minus the usual tolerances, while the height of the protective embossments 227 would be 0.080 inch plus or minus the usual tolerances. After the basic structures of the frusto-conical and differently sized dimples are formed in a given end closure 210 at station 1, this end closure 210 is moved in the manner previously described to the second station of press 28 where the die set at the second station shown in FIGS. 9 and 11 through 13 then operates in a manner previously described to form the primary and secondary base sections 221 and 222 for each tab 220 and 220' along with the annular web sections 224 and tab hinges 225 in the smallest and largest dimples and without materially affecting the centrally disposed dimple 218. During the forming operation at station 2 with the exception of the tear lines 224' and the formation of the depression 21' by the rib 108, if its is used in a base 221, there is substantially no thinning or intentional thinning of the material of end closure 210 as the bases of the tabs 220 and 220' are cold worked at this station. It is to be understood, of course, that in the case of where the residual tear line 224' of any tab such as tab 220', is still to be a major part of the web 224 of the tab as in the case of the tab of FIG. 24, the tooling at station 2 will be appropriately modified whereby cavity 97 of the tooling would be made longer and extend for the distance desired to accommodate and form the larger hinge 225.

The material making up the end closure 210 is controllably cold worked and controllably cold flowed during the forming operations at station 2, in substantially the same fashion as previously described in connection with the forming, for example, of the end closure of FIGS. 1–4A.

Further, in an advantageous embodiment of the invention at least the tops of the bases 221 and 222 of tabs 220 and 220' are shaped so as to be horizontally offset as well as vertically offset by the tooling at station 2 in order to help establish the desired areas of least resistance to fracture in the final tabs 220 and 220', all as previously discussed.

Advantageous embodiments of the invention have been disclosed and described and various changes can be made therein without departing from the inventive concepts as defined in the appended claims wherein:

What is claimed is:

1. A method for producing an easy open closure member having at least one depressible tab comprising the steps of selecting a closure blank of ductile metal and provided with a main panel and an outer peripheral reinforcing rib, initially working and simultaneously subjecting a portion of the panel closer to the center of the panel than to said rib and at least one additional portion of the panel located intermediate a selected part of the said rib and first mentioned portion of the panel to selective drawing pressures and forming an embossment in said first mentioned panel portion and a shallow outwardly disposed dimple in said second mentioned panel portion without at the same time effecting any significant thinning of the metal in the wall of the said dimple except in the extreme top portion thereof, then without materially disturbing at least the major part of the embossment and while controlling the flow of the metal making up the dimple and directing the metal in the top of the dimple slightly outwardly into a confined arcuate opening, reworking and reshaping the metal in the peripheral base portion of the said dimple to form selectively offset concentric inner and outer dimple base sections interconnected by a web and then without effecting any material thinning of any part of the dimple located in the arcuate opening and at least most of said base sections subjecting said web to compressive forces and materially thinning all but a selected amount of the material in the said web to provide an embrittled thin tear line section in the web and while effecting said thinning of the web and forming said tear line section allowing the terminal ends of the tear line section to form and recede into a depressible tab hinge portion.

2. A method as set forth in claim 1 wherein the initial formation of the embossment and dimple is effected at one station and the reworking and reshaping of the peripheral base portions of the dimple are effected at another station.

3. A method as set forth in claim 1, including the step of controllably cold flowing the metal in the top of the dimple into said arcuate opening without locking the said top of the dimple within the arcuate opening.

4. A method as set forth in claim 1 wherein the tear line section is formed by bilaterally pinch scoring the major part of the web while controlling and directing excess metal that builds during said scoring away from said tear line section being formed and into the confined arcuate opening.

5. A method as set forth in claim 1 including the step of initially forming a further outwardly disposed dimple simultaneously with the initial forming of said first dimple and locating said further dimple substantially the same distance from but on the other side of the center of the panel as the said first dimple and reworking and reshaping the metal in the base portion of said further dimple in the same fashion as and simultaneously with the reshaping and reworking of the base portion of said first dimple.

6. A method as set forth in claim 1 including the step of initially forming a further outwardly disposed dimple of larger size than said first dimple simultaneously with the initial forming of said embossment and first dimple and locating said second dimple on a different side of the embossment from said first dimple and reworking and reshaping the metal in the base portion of said further dimple in the same fashions as and simultaneously with the reshaping and reworking of the base portion of said first dimple.

7. A method as set forth in claim 5 wherein the initial forming of the dimples and embossment is effected at one station and the reworking and reshaping of the dimples are effected at a further station.

8. A method as set forth in claim 7 wherein the initial forming of the dimples and embossment is effected at one station and the reworking and reshaping of the dimples are effected at a further station.

9. A method for producing an easy open closure member having depressible button-like tabs comprising the steps of selecting a closure blank of a ductile metal and provided with a relatively flat main panel surrounded by a reinforcing peripheral rib, initially working and subjecting the metal in an area of the panel located inwardly from the rib and the metal at two other points located to either side of said first mentioned panel area to outward bulging pressures to form an embossment in said panel area and a pair of shallow dimples adjacent thereto while at least maintaining the thickness of all but the topmost parts of the walls of the dimples close to the original thickness of the panel, thereafter without significantly disturbing at least the major part of the embossment and while controlling the cold flow of the metal making up the dimples directing the metal in the top parts of the dimples slightly outwardly into separate arcuate cavities, reworking and reshaping the metal of the panel in the peripheral base portion of each dimple to form separate concentric inner and outer base portions for each dimple interconnected by a separate web portion without effecting any material thinning of the metal of the dimples located in the respective dimple cavities and the metal in at least most of the said base portions and during said reshaping and reworking significantly thinning all but small amounts of the metal in the web portion areas of the dimples to produce embrittled split annular tear lines in said significantly thinned areas one for each dimple and while effecting a significant thinning of each of said web portion areas directing excess metal that builds up from the thinned web portion areas toward the respective cavities associated therewith.

10. A method as set forth in claim 9 wherein the initial formation of the dimples and embossment is effected at one station and the reworking and reshaping of the peripheral base portions of the dimples are effected at another station.

11. A method as set forth in claim 9 including the step of controllably cold flowing metal in the top of a dimple into its respective arcuate cavity without locking the said top within its associated arcuate cavity.

12. A method as set froth in claim 9 wherein the tear line section of a given dimple is formed by bilaterally pinch scoring the web portion of the given dimple and while controlling and directing excess metal in the web portion resulting from the scoring away from the tear line section.

13. A method as set forth in claim 12 wherein the dimples that are initially formed and then reshaped and reworked are of different dimensions and the initial formation of the dimples and the embossment is effected at one station and the reshaping and reworking of the peripheral base portions of the dimples are all effected at another station.

14. A method for producing an easy open closure member having at least one depressible tab comprising the steps of selecting a closure blank of ductile metal and provided with a main panel and an outer peripheral reinforcing rib, initially working and simultaneously subjecting predetermined portions of the panel to selective outward drawing pressures and forming embossments in the panel and a shallow outwardly disposed dimple in said panel portions without at the same time effecting any significant thinning of the metal at least in the bottom part of the wall of the said dimple and while making at least one of said embossments of a greater height than said dimple, then without materially disturbing at least the major parts of the embossments while maintaining the said height relationships and while controlling the flow of the metal making up the dimple directing the metal in the top of the dimple slightly outwardly into a confined arcuate opening, reworking and reshaping the metal in the peripheral base portions of the said dimple to form selectively offset concentric inner and outer dimple base sections interconnected by a web, and without effecting any material thinning of any part of the dimple located in the arcuate opening and most of said base sections subjecting said web to compressive forces and materially thinning all but a selected amount of the material in the said web to provide an embrittled thin tear line section in the web and during the said thinning of the web and the forming said tear line section allowing the terminal ends of the tear line section to form and recede into a depressible tab hinge portion.

15. A method as set forth in claim 14 wherein the initial formation of the embossments and dimple is effected at one station and the reworking and reshaping of the peripheral base portions of the dimple are effected at another station.

16. A method as set forth in claim 14, including the step of controllably cold flowing the metal in the top of the dimple into said arcuate opening without locking the said top of the dimple within the arcuate opening.

17. A method as set forth in claim 14 wherein the tear line section is formed by bilaterally pinch scoring the web while controlling and directing excess metal that builds during said scoring away from said tear line section being formed and into the confined arcuate opening.

18. A method as set forth in claim 17 including the step of initially forming a further outwardly disposed dimple of larger size than said first dimple but of a smaller height than the highest embossment simultaneously with the initial forming of said embossments and first dimple and locating said second dimple on a different side of one of the embossments from said first dimple and reworking and reshaping the metal in the base portion of said further dimple in the same fashion as and simultaneously with the reshaping and reworking of the base portion of said first dimple including the maintenance of the said dimple and embossment height relationships.

19. A method as set forth in claim 18 wherein the initial forming of the dimples and embossments is effected at one station and the reworking and reshaping of the dimples are effected at a further station.

20. A method as set forth in claim 14 including the step of forming certain of said embossments into elongated bar-like elements located on opposing sides of the dimple.

21. In an apparatus for producing a metal container closure member provided with depressible tab means formed integrally with the closure member, the combination of a first station provided with cooperating and opposing die segments, at least one of said segments being movable relative to the other and one of said die segments being provided with a plurality of selectively spaced arcuately headed punches, the other of said segments being provided with a plurality of die cavities arranged in opposed relation to the punches of said one die segment, a resiliently biased centering ring means associated with one of the first station die segments for engaging the peripheral portion of a container closure member and for centering and holding said closure member in place during the time the first station die segments are brought into a closed relationship and dimple-like embossments are formed in the closure member by the action of the punches thereagainst, a second station, means for transferring the initially embossed container closure member from the first to the second station, said second station also being provided with cooperating and opposing die segments at least one of which is movable relative to the other, one of the second station die segments having at least one cavity portion encompassed by a stepped shoulder portion for engaging and working the under surface of the closure member at the base of a dimple-like embossment when the second station die segments are brought together in a closed relationship, and the other second station die segment also having at least one cavity portion of a smaller peripheral dimension than said first mentioned cavity portion of the first mentioned second station die segment, said smaller cavity portion of the other second station die segment also being encompassed by a stepped shoulder portion that registers and cooperates with the first mentioned stepped shoulder portion of the first mentioned die segment at the second station and engages the upper surface of the closure member at the base of the said dimple-like embossment when the second station die segments are brought together in a closed relationship whereby said first and second mentioned stepped shoulder portions can reshape the base of the dimple-like embossment and complete the formation of a tab means at the second station.

22. An apparatus as set forth in claim 21 wherein the first cavity portion of the one die segment at the second station has an inverted frusto-conical surface and the smaller cavity portion of the opposing die segment is generally hemispherical in configuration.

23. An apparatus as set forth in claim 21 including a resiliently biased centering ring cooperatively associated with one of the die segments at said second station for engaging and centering the closure member relative to the die segments at said second station.

24. An apparatus as set forth in claim 21 wherein at least one of said die segments at said second station is provided with a removable die insert which is the portion of the apparatus at the second station provided with one of the said cavity portions.

25. An apparatus as set forth in claim 21 wherein both of the die segments at said second station are provided with removable die inserts which are the parts of the apparatus at the second station provided with said cavity portions.

26. An apparatus as set forth in claim 21 wherein one of the die segments at said second station is provided with at least one removable die insert which contains one of the said cavity portions and a guide and protective plate surrounding said removable die insert.

27. An apparatus as set forth in claim 26 wherein said guide and protective plate is made up of cooperating segments.

28. An apparatus as set forth in claim 26 wherein said guide and protective plate is provided with a dimple-like embossment receiving cavity means.

29. An apparatus as set forth in claim 28 wherein said plate is made up of cooperating segments.

30. An apparatus as set forth in claim 21, wherein one of the cavity portions of a die segment at the second station has an inverted frusto-conical surface.

31. An apparatus as set forth in claim 21 wherein one of the cavity portions of a die segment at the second station has a hemispherical configuration.

32. In an apparatus for producing a metal container closure member provided with depressible tab means formed integrally with the closure member, the combination of a first station provided with cooperating and opposing die segments, at least one of said segments being movable relative to the other and one of said die segments being provided with a plurality of selectively spaced arcuately headed punches and other embossment forming elements of a greater height than the punches, the other of said segments being provided with a plurality of die cavities arranged in opposed relation to the punches and said other embossment forming elements of said one die segment, a resiliently biased centering ring means associated with one of the first station die segments for engaging the peripheral portion of a container closure member and for centering and holding said closure member in place during the time the first station die segments are brought into a closed relationship and dimple-like embossments and protective embossments are formed in the closure member by the action of the punches and the other embossment forming elements thereagainst, a second station, means for transferring the initially embossed container closure member from the first to the second station, said second station also being provided with cooperating and opposing die segments at least one of which is movable relative to the other, one of the second station die segments having at least one cavity portion encompassed by a stepped shoulder portion for engaging and working the under surface of the closure member at the base of a dimple-like embossment when the second station die segments are brought together in a closed relationship, and the other second station die segment also having at least one cavity portion of a smaller peripheral dimension than said first mentioned cavity portion of the first mentioned second station die segment, said smaller cavity portion of the other second station die segment also being encompassed by a stepped shoulder portion that registers and cooperates with the first mentioned stepped shoulder portion of the first mentioned die segment at the second station and engages the upper surface of the closure member at the base of the said dimple-like embossment when the second station die segments are brought together in a closed relationship whereby said first and second mentioned stepped shoulder portions can reshape the base of the dimple-like embossment and complete the formation of a tab means at the second station.

33. An apparatus as set forth in claim 32 wherein the first cavity portion of the one die segment at the second station has an inverted frusto-conical surface and the smaller cavity portion of the opposing die segment is generally hemispherical in configuration.

34. An apparatus as set forth in claim 32 wherein at least one of said die segments at said second station is provided with a removable die insert which is the portion of the apparatus at the second station provided with one of the said cavity portions.

35. An apparatus as set forth in claim 32 wherein the other embossment forming elements at said first station comprise removably pin-like elements.

36. An apparatus as set forth in claim 32 wherein the other embossment elements at said first station further include bar-like ribs.

37. An apparatus as set forth in claim 32 wherein the other embossment forming elements at said first station include bar-like ribs.

38. In an apparatus for producing a metal container closure member provided with depressible tab means formed integrally with the closure member, the combination of a first station provided with cooperating and opposing die segments, at least one of said segments being movable relative to the other and one of said segments being provided with a plurality of selectively spaced arcuately headed punches and other embossment forming elements of a greater height than the punches, the other of said segments beig provided with a plurality of die cavities arranged in opposed relation to the punches and said other embossment forming elements of said one die segment, a second station, means for transferring the initially embossed container closure member from the first to the second station, said second station also being provided with cooperating and opposing die segments at least one of which is movable relative to the other, one of the second station die segments having at least one cavity portion encompassed by a stepped shoulder portion for engaging and working the under surface of the closure member at the base of a dimple-like embossment when the second station die segments are brought together in a closed relationship, and the other second station die segment also having at least one cavity portion of a smaller peripheral dimension that said first mentioned cavity portion of the first mentioned second station die segment, said smaller cavity portion of the other second station die segment alos being encompassed by a stepped shoulder portion that registers and cooperates with the first mentioned stepped shoulder portion of the first mentioned die segment at the second station and engages the upper surface of the closure member at the base of the said dimple-like embossment when the second station die segments are brought together in a closed relationship whereby said first and second mentioned stepped shoulder portions can reshape the base of the dimple-like embossment and complete the formation of a tab means at the second station.

* * * * *